US005503435A

United States Patent [19]

Kline

[11] Patent Number: 5,503,435

[45] Date of Patent: Apr. 2, 1996

[54] METHOD FOR CUSTOMIZING INDEX DIVIDER SETS RELATIVE TO A TABLE OF CONTENTS SHEET

[75] Inventor: Brant D. Kline, La Canada, Calif.

[73] Assignee: Avery Dennison Corporation, Pasadena, Calif.

[21] Appl. No.: 332,840

[22] Filed: Nov. 1, 1994

[51] Int. Cl.[6] ..... B42D 15/00

[52] U.S. Cl. ..... 283/67; 283/36; 283/37; 402/79

[58] Field of Search ..... 283/67, 70, 81, 283/36, 37, 41, 117; 402/79; 281/38

[56] References Cited

U.S. PATENT DOCUMENTS

| | | | |
|---|---|---|---|
| 945,765 | 1/1910 | Drake . | |
| 955,038 | 4/1910 | Bagby . | |
| 1,069,092 | 7/1913 | Wise . | |
| 3,938,268 | 2/1976 | Gilhuh | 283/36 X |
| 4,949,999 | 8/1990 | Ke-hui | 283/36 X |
| 4,973,086 | 11/1990 | Donelly et al. | 402/79 X |
| 4,978,143 | 12/1990 | Ericson | 283/37 X |
| 4,993,752 | 2/1991 | Juzak . | |
| 5,007,663 | 4/1991 | Moran . | |
| 5,123,676 | 6/1992 | Donnelly et al. . | |
| 5,135,261 | 8/1992 | Cusack et al. . | |
| 5,299,879 | 4/1994 | Burrow . | |
| 5,316,344 | 5/1994 | Popat et al. . | |

OTHER PUBLICATIONS

*The Original OneStep® Index System;* Cardinal products, St. Louis, MO; Copyright 1992.

*Five Easy Ways To Make Avery Ready Index® Dividers;* Avery Dennison Corporation; Copyright 1993, 1994.

*Three Easy Ways To Make Avery Ready Indexes®;* Avery Commercial Products Division.

*Primary Examiner*—Willmon Fridie, Jr.

*Attorney, Agent, or Firm*—Poms, Smith, Lande & Rose

[57] ABSTRACT

First and second index divider sheets, each having outward tabs vertically offset from one another, and a table of contents page are provided, with first and second labels releasably attached to the front of the table of contents page generally adjacent to but spaced from first and second descriptive field areas of that page. The page is passed through a printer or copier and custom indicia are printed in the same operation on the labels and in the field areas. The labels are then removed by the user and attached by their adhesive backings to the respective tabs on one or both sides thereof. The labels before printing are adhered directly to the table of contents page inward of the descriptive field areas, to a removable carrier strip which itself is adhered to the front of the page or to a tear-away strip at the bottom of the page.

17 Claims, 3 Drawing Sheets

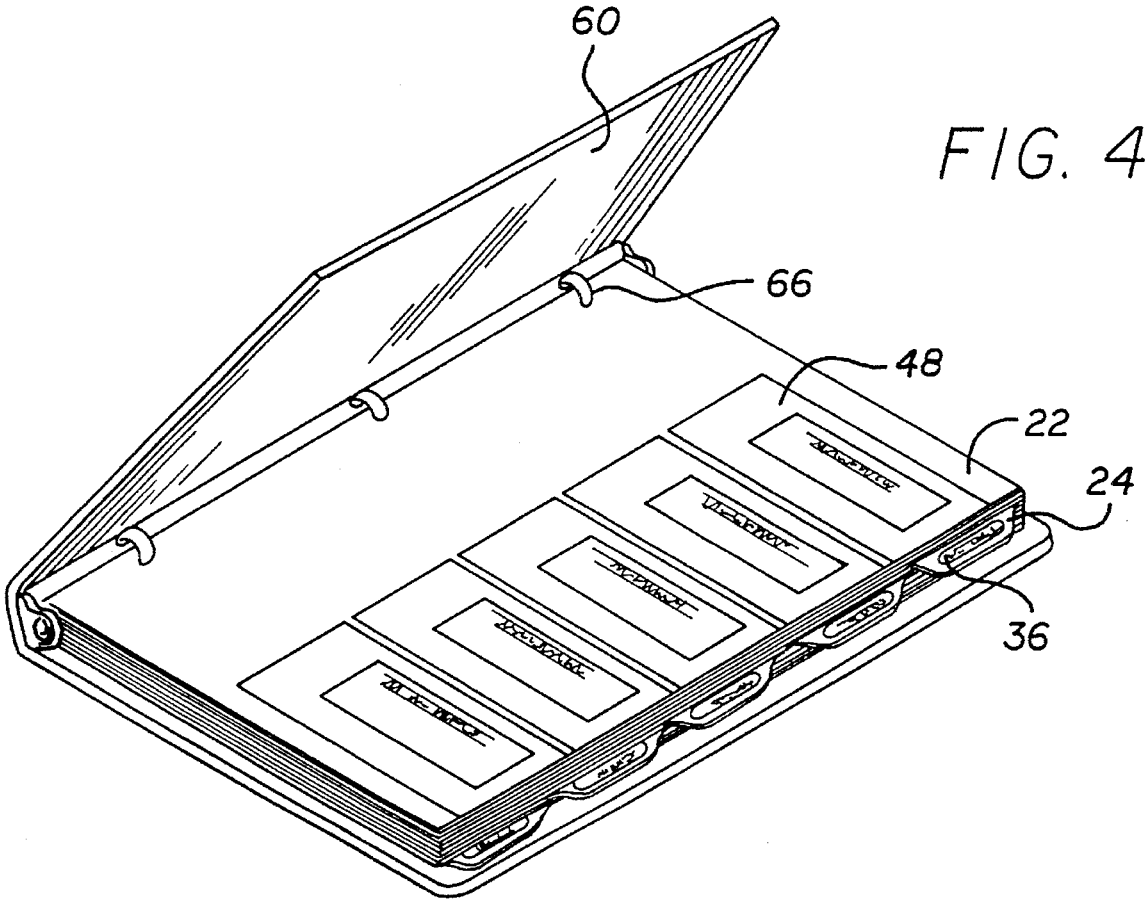
FIG. 4
FIG. 5
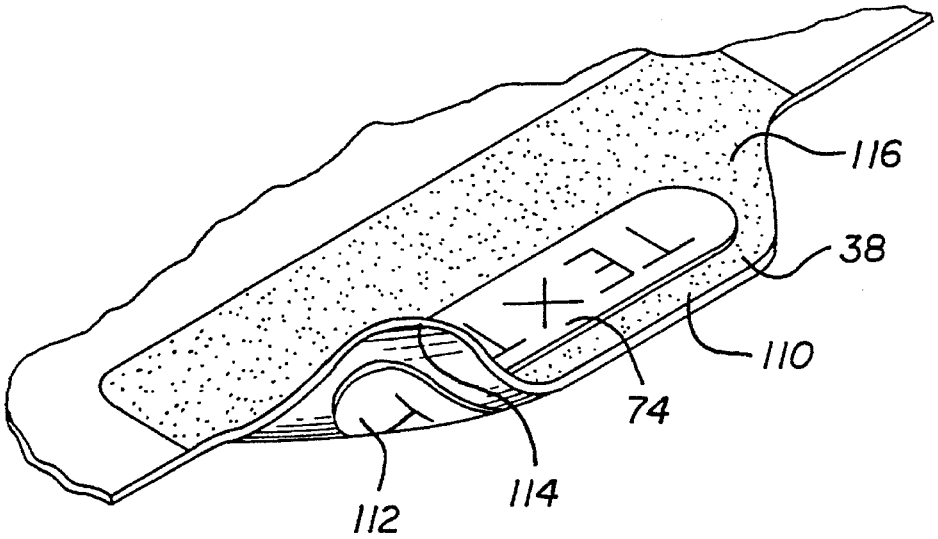

METHOD FOR CUSTOMIZING INDEX DIVIDER SETS RELATIVE TO A TABLE OF CONTENTS SHEET

BACKGROUND OF THE INVENTION

The present invention relates to systems for organizing and indexing documents wherein the systems include index divider sets and a table of contents page. It further concerns methods for user-customizing these systems.

One known prior art system is that of U.S. Pat. No. 5,135,261 (Cusack et al.) which discloses index tab label assemblies used for notebooks, dividers, files and the like wherein the labels have coatings that facilitate printing thereon. In other words, the label is preferably transparent and can be attached by a pressure sensitive adhesive directly to the tab of a divider or file. The label is made out of a polyester film having a pressure sensitive adhesive attached to one side of the film and a coating applied to the other side of the sheet. That is, the printed label is attached by pressure sensitive adhesive directly to a tab or a divider or file to make an index tab, or to a tab reinforcer attached to the tab.

U.S. Pat. No. 5,316,344 (Popat et al.) ('344) discloses a stationery sheet having labels removably attached thereto by pressure sensitive adhesive. The sheet may be sent through laser printer or other printing equipment to print indicia on the sheet and the label. After the sheet exits the printer the labels can be peeled off the sheet and attached to a letter for example. The special adhesive characteristics of the repositionable labels used therein facilitate peeling from the carrier sheet without the need for a release coating which would otherwise mar the appearance of the sheet. Another commercial product is that available from the present assignee (Avery Dennison Corporation of Pasadena, Calif.) and is marketed as the Ready Index® Dividers. It provides for the quick organization of binders. The Ready Index® table of contents page is simply filled in by the user by means of a printer and a computer running commonly-available word-processing software or by typewriter or by photocopying a previously-printed master copy. The tabs are color and number coded to match the table of contents page. The methods of making these dividers are described in the two-page publication entitled "Five Easy Ways To Make Avery Ready Index® Dividers," copyright 1993, 1994, IFS-0203. (This publication and the two above-mentioned patents are hereby incorporated by reference in their entireties.) This publication discusses that computer programs are available for setting up preset page layouts making it easy to format and print the index dividers. If templates are not included with the software, the publication describes a process of manually creating the templates. It also describes how the system can work with typewriters and copiers if a computer is not available.

An example of another "index" system is the OneStep® Index System available from Cardinal Products of St. Louis, Mo. It is advertised as requiring no tab typing or tab inserting. Rather for one set all that is required is that the section title be typed on the table of contents sheet. According to their advertisement (copyright 1992) it can be used with all copiers and laser printers. The OneStep® system does not provide means for the user to add custom indicia to the tabs of the divider pages. Such custom indicia is generally more descriptive than a scheme of numbers or letters and is, therefore, more useful to the consumer.

No system and method is known, however, for quickly creating a professional quality user-customized system of index divider sets complete with a customized table of contents page. Also, this system should minimize the waste of labels and provide a reliable feed and transport through laser and ink jet printers and copiers.

SUMMARY OF THE INVENTION

Directed to achieving these objects, a user-customizable index divider sheet set and table of contents sheet assembly and method therefor are herein disclosed. This assembly includes a set of index dividers and a partially preprinted table of contents page on which a plurality of adhesively-attached but removable labels are mounted. The user can use readily available word processing software, formatted appropriately to the layout of the table of contents page, to print custom indicia in the description fields on that page and in the same operation on the labels attached thereto. Following printing, the labels are peeled from the table of contents page and attached (by the user) to the tabs of the divider pages. This provides a set of custom-labeled divider pages and a corresponding table of contents page prepared with minimum user effort.

The tabs can be color, shading or pattern matched to the text field highlights of the table of contents page and can contain some or no preprinted indicia. This is most conveniently achieved by printing directly on the tabs or by laminating a colored, shaded or patterned reinforcing film to the tabs. The dividers may be associated with their descriptive text fields on the table of contents page by color, shading or pattern or by their position relative to the top or bottom edge of the page. The labels may be clear or opaque, colored or colorless and may be positioned on one face of the tab, may wrap around to be visible on both sides, or may be created in pairs to provide one label for each side of the tab. The construction of the table of contents page with attached labels may follow the repositionable label technology as described in the previously-mentioned '344 patent or may employ more common pressure-sensitive adhesive technology in conjunction with release treatments.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 4 is a perspective view of the assembly of FIG. 1 shown organized and in place in a folder, binder or the like; and FIG. 5 an enlarged view of the tab portion of one of the divider sheets of the assembly of FIG. 1 illustrating an embodiment with labels adhered by the user to both tab sides.

DETAILED DESCRIPTION OF THE PREFERRED EMBODIMENTS

Figure 1:
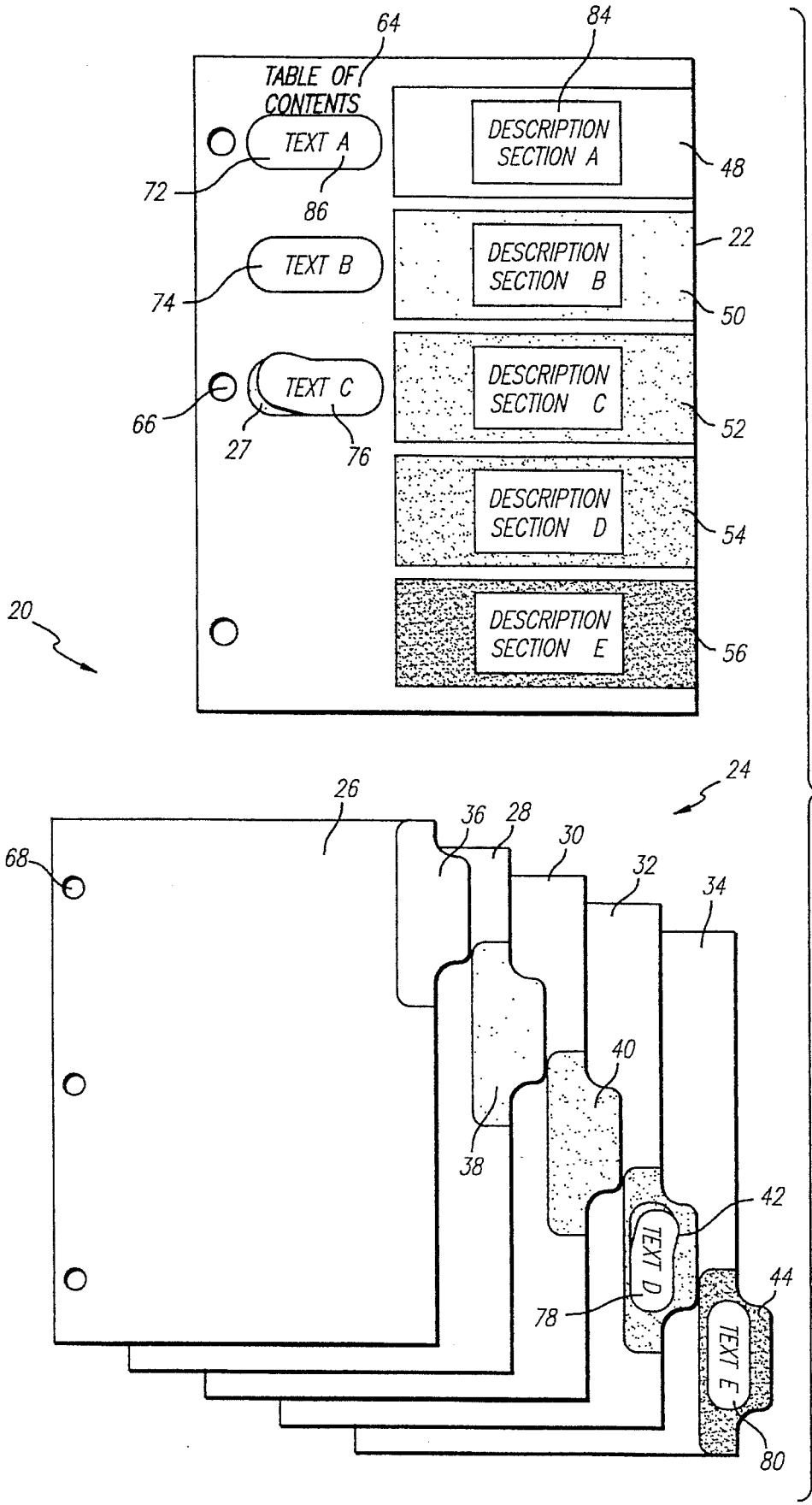
FIG. 1 is a front elevational view of a user-customizable index divider set and table of contents sheet assembly or system of the present invention.

Referring to FIG. 1, an assembly of the present invention is shown generally at 20 and includes a table of contents sheet 22 and a set of divider sheets shown generally at 24.

The divider sheets set 24 can include generally any number of divider sheets more than two, and five divider sheets are illustrated in FIG. 1 by reference numerals 26, 28, 30, 32, 34. Each divider sheet includes along its outboard or right edge an outwardly extending tab 36, 38, 40, 42, 44, respectively, which is preferably reinforced by lamination on both sides with a thin plastic film which may be clear or opaque, colored or colorless. On the right or outboard half of the table of contents sheet 22 are five horizontally-oriented descriptive field areas 48, 50, 52, 54, 56. With the table of contents sheet 22 and the set of divider sheets 24 arranged and inserted in a file, binder or the like as shown in FIG. 4 generally at 60, the descriptive field areas 48, 50, 53, 54, 56 are in horizontal alignment with the tabs 36, 38, 40, 42, 44 of its corresponding divider sheet.

For quick reference each of the descriptive field areas 48, 50, 52, 54, 56 can have a different color, pattern, shading or the like, and each of the tabs 36, 38, 40, 42, 44 can have a different color, pattern, shading or the like corresponding to that of the corresponding descriptive field area, as represented by the different stipplings for each as drawn in FIG. 1. This may be achieved by printing, patterning or coloring the reinforcing film or by preprinting the tab portion of the divider page and overlaminating with a clear reinforcing film. When the set of divider sheets 24 are arranged in the binder 60, the tabs 36, 38, 40, 42, 44 of adjacent divider sheets are vertically off-set in a known manner for easy viewing, access and manipulation. If many divider sheets are needed to separate different groupings of papers in the binder 60 and the tab of the first divider sheet is at the top of that sheet and the tab of the last divider sheet is at the bottom of that sheet, then a second set of divider sheets (not shown) and a second table of contents page (not shown) can also be used in the binder 60.

The table of contents sheet 22 will preferably have width and length dimensions of 8½ by eleven inches, a thickness of 0.0045 inch and a weight of twenty-four pounds per 1300 square feet. Each of the divider sheets of set 24 can have width and length dimensions of nine inches by eleven inches, a thickness of 0.008 inch and a weight of a hundred and ten pounds per 3300 square feet. The descriptive field areas 48, 50, 52, 54, 56 are formed on the table of contents sheet 22 according to the process of offset, gravure or other conventional methods of printing. The table of contents sheet 22 preferably will have "Table of Contents" or a similar title 64 (written) prominently thereon. Each of the tabs 36, 38, 40, 42, 44 will have dimensions of ½ inch high by 1¼ to 3¼ inches in length, depending on the number of tabs in the set. And they may contain some or no preprinted indicia. An example of when it is desirable to include preprinted indicia is the use of a company logo or event identifier to be used in multiple sets.

According to a preferred embodiment the tabs 36, 38, 40, 42, 44 are formed on the divider sheet by die-cutting using machinery available from, for example, the Scott Machine Company. The table of contents sheet 22 and each of the divider sheets of set 24 will preferably have three spaced vertically aligned holes 66, 68, respectively, on their left or inboard side to fit into a conventional three ring binder 60, as depicted in FIG. 4. However, different number and/or placement of the holes (66, 68) or no holes as desired can be used.

In addition to the descriptive field areas 48, 50, 52, 54, 56, on the front of the table of contents sheet 22, repositionable labels 72, 74, 76, 78, 80 are releasably adhered to the front. The labels 72, 74, 76, 78, 80 can have dimensions of ½ inch by one to three inches. The labels are formed of paper or plastic film such as polyethylene terephthalate sold commercially as Mylar™ which may be coated or textured on one surface to enhance printability and coated on the reverse surface thereof with a pressure-sensitive adhesive and may be clear or opaque, colored or colorless.

Using common word processing software, such as Word© available from Microsoft Corporation, WordPerfect© available from Word Perfect, or Ami Pro© available from Lotus Development Corporation, appropriately formatted to the layout of the table of contents sheet 22, the user causes custom indicia 84 to be printed in the descriptive field areas 48, 50, 52, 54, 56 and in the same operation custom indicia 86 to be printed on the labels 72, 74, 76, 78, 80 attached to the front of the table of contents sheet 22. This printing can be in a laser printer, an ink jet printer or a photocopying machine, and a preferred printer (not shown) is the "LaserJet 4 Plus" printer available from Hewlett Packard Corporation.

The labels 72, 74, 76, 78, 80 are attached to the front of the table of contents sheet 22 with a repositionable pressure sensitive adhesive 90, such as the "Clean Tac" adhesive available from Moore Pressure Sensitive Systems, on the back side of the labels. Another adhesive which can be used is the "P09" adhesive from Avery Dennison Corporation, or generically, a modified acrylic pressure-sensitive type of adhesive used in conjunction with surfaces treated with release agents such as silicones. This adhesive maintains the labels 72, 74, 76, 78, 80 attached to the table of contents sheet 22 during the printing operation, allowing the custom indicia 86 to be printed on the labels while attached to the sheet, and subsequently after printing, allows the labels to be peeled off from the table of contents sheet intact, manually by the user. After having been peeled therefrom they are repositioned by the user and attached to the respective tabs 36, 38, 40, 42, 44 of the divider sheets by the adhesive.

Referring to FIG. 1, the divider sheet 34 shows label 80 having been attached to the tab 44 and divider sheet 32 shows label 78 being attached to the tab 42 thereof. Similarly, the table of contents sheet 22 shows labels 72 and 74 still attached to the page and label 76 in the process of being removed therefrom. In the table of contents sheet 22 of this embodiment the labels 72, 74, 76, 78, 80 are attached by adhesives directly to the front side of the table of contents sheet 22 and on the left or inboard side thereof, vertically arranged.

Figure 2:
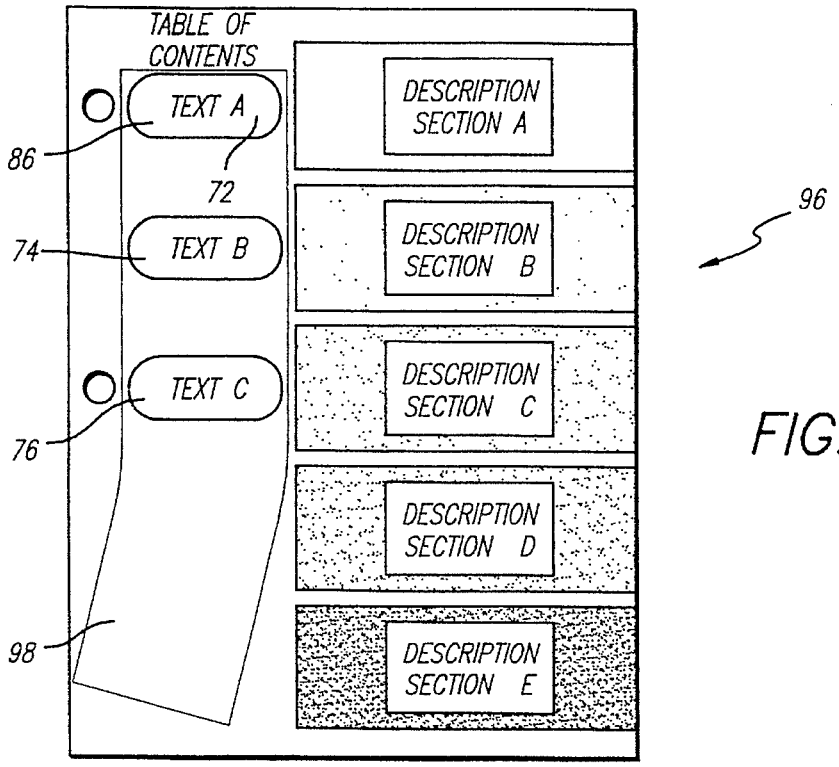
FIG. 2 is an elevational view of an alternative table of contents sheet for the assembly of FIG. 1.

Another embodiment of a table of contents sheet of this invention is shown in FIG. 2 generally at 96. It is seen therein that each of the labels 72, 74, 76, 78, 80 is adhered directly to a carrier strip 98 which in turn is releasably adhered to the front of the table of contents sheet 96 on the left side thereof by a fugitive type of adhesive which leaves a tack-free surface with no visual evidence of having been adhered following separation. The carrier strip 98 can be made of plastic film or coated paper and can have dimensions of up to eleven inches by one to 3½ inches, a thickness of 0.002 inch and a weight of twenty-nine pounds per 3000 square feet.

After the custom indicia 86 have been printed on the labels 72, 74, 76, 78, 80, the labels can be removed from the carrier strip 98 with the carrier strip still attached to the table of contents sheet 96. The preferred method though is to first remove the carrier strip 98; that is, the carrier strip with the custom-indicia printed labels attached thereto is removed from or peeled off of the table of contents sheet 96 and then each of the labels is removed from the strip. This carrier strip 98 embodiment has the advantage that less manipulation is needed of the table of contents sheet while the labels are individually removed. This becomes more important when the number of labels used is great and thus the number of manipulation steps on the table of contents sheet increases to remove the labels. The removal of the labels by careless action may cause smudging, marking or wrinkling on the sheet.

Figure 3:
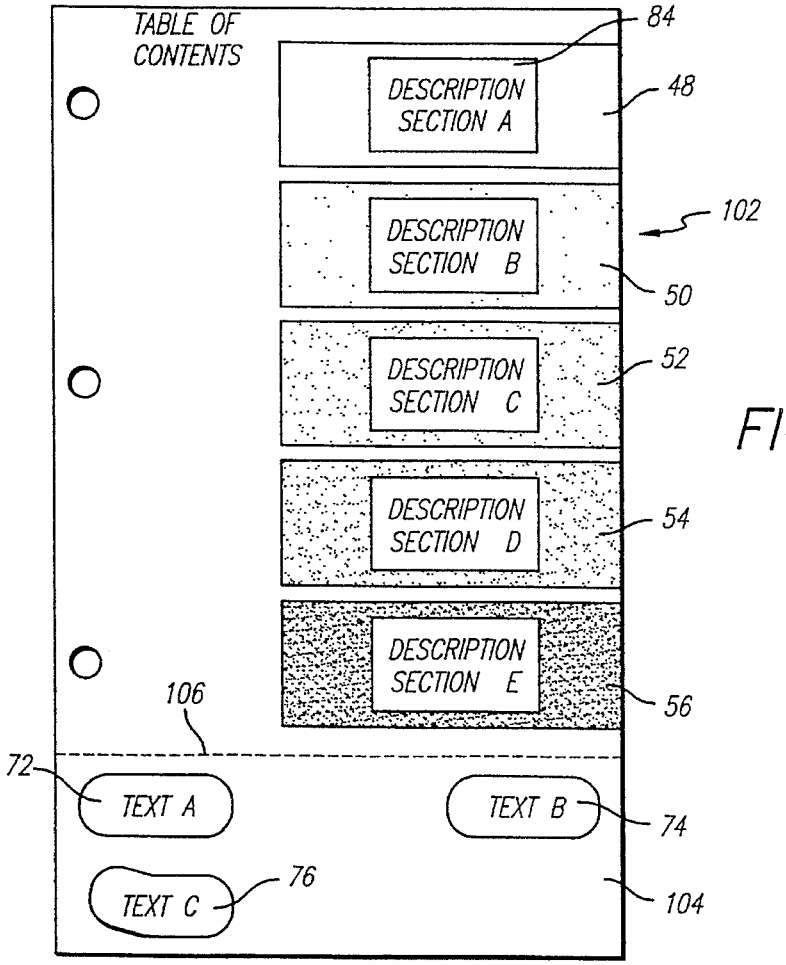
FIG. 3 is an elevational view of another alternative table of contents sheet for the assembly of FIG. 1.

Another embodiment of the table of contents page or sheet of this invention is illustrated in FIG. 3 generally at 102. It is seen therein that the table of contents sheet 102 has the same width dimension as sheets 22 and 96 shown in FIGS. 1 and 2, but a longer length dimension of approximately fourteen inches. At the bottom of the sheet 102 is a tear-off strip 104 having dimensions of 8½ inches by three inches. The tear-strip 104 is of the same weight, thickness, and material as the rest of the table of contents sheet 102 but has been treated on the front surface thereof with release chemicals to facilitate removal of the labels. The tear-off strip 104 is separated therefrom by a horizontal perforation line 106 having perforations and ties of approximately fifty per inch. The perforations have a length dimension relative to the ties of about 0.014 inch to 0.006 inch so that removal of the strip leaves a relatively smooth edge on the bottom of the table of contents sheet. The labels 72, 74, 76, 78, 80 are directly attached to the tear-off strip 104 at the foot end of the sheet 102. Thus, after the custom indicia 84, 86 have been printed in the descriptive field areas 48, 50, 52, 54, 56 and on the labels, the tear-off strip 104 is torn away along the perforation line 106 and each of the labels is sequentially removed and attached to its respective divider sheet tab.

One embodiment of the invention attaches the labels (74, for example) only to the front side 110 of the tab (38, for example). Another preferred embodiment of the invention provides for two labels 74, 112 to be printed in the same printing operation, each removed from the table of contents sheet 22, 96 or 102 and one (74) applied to the front side 110 of the tab and the other 112 to the back side 114 of the tab, as best illustrated in FIG. 5, which also shows reinforced tab area 116. The spines of the divider sheets may also be reinforced. A further embodiment is to provide for a single elongate label (not shown) having first and second halves and custom indicia printed on both of the halves. The indicia printed on both halves of the tabs will preferably be the same. The label after printing is removed from the table of contents sheet (22, 96 or 102) and applied to the tab (38) by wrapping it around from one side of the tab to the other.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A method for customizing index divider sets relative to a table of contents sheet, comprising the steps of:

providing a table of contents sheet having on a front side thereof first and second descriptive fields and releasable first and second labels;

printing custom indicia on at least one of the descriptive field and the label with the labels mounted to the table of contents sheet, such that the first label visually corresponds to the first descriptive field and the second label visually corresponds to the second descriptive field;

providing a first divider sheet having an outwardly-extending first tab positioned to be horizontally aligned with the first descriptive field when the first divider sheet and the table of contents page are in an aligned position and visually matched to the first descriptive field;

providing a second divider sheet having an outwardly-extending second tab positioned to be horizontally aligned with the second descriptive field when the second divider sheet and the table of contents page are in an aligned position and visually matched to the second descriptive field;

after said printing step, removing the first label from the table of contents page and attaching it to the first tab; and after said printing step, removing the second label from the table of contents page and attaching it to the second tab.

2. The method of claim 1 wherein said table-of-contents sheet providing step includes the table of contents sheet having releasable third and fourth labels, and said printing step includes printing custom indicia on the first, second, third and fourth labels.

3. The method of claim 2 further comprising after said first label attaching step, attaching the third label to a side of the first tab opposite to that of the first label, and after said second label attaching step, attaching the fourth label to the side of the second tab opposite to that of the second label.

4. The method of claim 1 wherein with the first divider sheet and the table of contents page in their aligned position and simultaneously the second divider sheet and the table of contents page in their aligned position, the first and second tabs are vertically offset from one another.

5. The method of claim 1 wherein said printing step includes printing in the same pass-through through a printer, custom indicia in the first and second descriptive fields and on the first and second labels.

6. The method of claim 1 wherein said first label removing step includes peeling the first label off from the table of contents sheet.

7. The method of claim 1 wherein said first label attaching step includes wrapping the first label around the first tab so that it attaches to both front and back sides of the first tab.

8. The method of claim 7 wherein said printing custom indicia step includes printing the same indicia on both right and left halves of the first label, such that after said wrapping step the same indicia is provided on both the front and back sides of the first tab.

9. The method of claim 1 wherein before said printing step, the table of contents sheet has a body portion which includes the first and second descriptive fields, a foot portion below the body portion and to which the first and second labels are releasably attached, and a perforation line separating the foot portion from the body portion.

10. The method of claim 9 further comprising after said printing step, separating the foot portion from the body portion by tearing along the perforation line.

11. The method of claim 1 wherein said table-of-contents sheet providing step includes a carrier strip releasably adhered to the front side and the first and second labels releasably adhered directly to the carrier strip.

12. The method of claim 11 wherein said first and second label removing steps include peeling the respective first and second labels off from the carrier strip.

13. The method of claim 12 further comprising before said peeling steps, removing the carrier strip from the front side.

14. The method of claim 1 wherein said printing step uses a laser or ink jet printer, a typewriter or a dot matrix printer.

15. The method of claim 1 wherein said printing step uses a photocopy machine and a master page prepared using a printer.

16. The method of claim 1 further comprising the steps of organizing and inserting the first and second divider sheets and the table of contents sheet in a binder.

17. The method of claim 1 wherein said custom indicia printing step includes the first and second labels visually corresponding to the first and second descriptive fields, respectively.

* * * * *